US008264133B2

(12) United States Patent
Takegoshi et al.

(10) Patent No.: US 8,264,133 B2
(45) Date of Patent: Sep. 11, 2012

(54) INCANDESCENCE LAMP WITH A REINFORCEMENT RIB

(75) Inventors: Koichi Takegoshi, Suzhou (CN); Kazuyuki Ikushima, Guangdong Province (CN); Tadakazu Kawamura, Hyogo (JP)

(73) Assignee: Ushio Denki Kabushiki Kaisha, Tokyo (JP)

( * ) Notice: Subject to any disclaimer, the term of this patent is extended or adjusted under 35 U.S.C. 154(b) by 206 days.

(21) Appl. No.: 12/662,064

(22) Filed: Mar. 30, 2010

(65) Prior Publication Data

US 2011/0241516 A1 Oct. 6, 2011

(51) Int. Cl.
*H01K 9/00* (2006.01)
*H01K 1/14* (2006.01)

(52) U.S. Cl. ..... 313/316; 313/315

(58) Field of Classification Search ..... None
See application file for complete search history.

(56) References Cited

U.S. PATENT DOCUMENTS

| | | | | |
|---|---|---|---|---|
| 6,559,421 | B1 | 5/2003 | Yura et al. | |
| 6,646,227 | B2 | 11/2003 | Yura et al. | |
| 6,897,409 | B2 | 5/2005 | Yura et al. | |
| 2007/0046167 | A1 * | 3/2007 | Lantis et al. | 313/311 |
| 2008/0224615 | A1 * | 9/2008 | Higashi et al. | 313/631 |

FOREIGN PATENT DOCUMENTS

| | | | |
|---|---|---|---|
| JP | 2001-126846 | A | 5/2001 |
| JP | 2009-117147 | A | 5/2009 |

* cited by examiner

*Primary Examiner* — Anh Mai
*Assistant Examiner* — Britt D Hanley
(74) *Attorney, Agent, or Firm* — Rader, Fishman & Grauer PLLC

(57) ABSTRACT

An incandescence lamp comprises an arc tube where both ends form sealing portions, a filament that extends in the arc tube in a tube axis direction, and a reinforcement rib that extends along the arc tube in the tube axis direction.

5 Claims, 2 Drawing Sheets

INCANDESCENCE LAMP WITH A REINFORCEMENT RIB

TECHNICAL FIELD

The present invention relates to an incandescence lamp and an incandescence lamp unit, and, especially relates to an incandescence lamp, which is arranged in a heating roller forming a heating apparatus of a heat roller fixing system or is used as a heat source for the heating roller, and an incandescence lamp unit, in an image forming apparatus, such as a copying machine, a laser printer, or a facsimile, using an electronic photograph method.

BACKGROUND

Conventionally, an incandescence lamp, which has a filament in a tube, is frequently used as a heat source. For example, as described in Japanese Patent Application Publication No. 2001-126846, a halogen heater is used in a fixing apparatus for an image forming apparatus, such as a copying machine, a printer, or a facsimile, wherein the thickness of the lamp is made smaller than that of the conventional glass tube (tube), thereby improving the transmittance of light thereof.

Moreover, an incandescence lamp unit, in which two or more incandescence lamps are arranged so as to correspond to the sizes of recording paper sheets, is also known. Japanese Patent Application Publication No. 2009-117147 discloses an example thereof, and FIG. 5 shows the schematic structure thereof, wherein a lamp unit 30, which consists of two or more rod-shaped heater lamps 31 and 32, is arranged as a heat source inside a heating roller which forms a heating fixing apparatus (not shown in the figure). In this apparatus, a filament 33, which is a light emission part, is arranged in the central part of one incandescence lamp 31, and internal leads 34 and 35, which are non-light emitting portions, are arranged at both sides thereof. Filaments 36 and 37 are arranged in the other incandescence lamp 32 so as to be shifted from the filament 33 of the one incandescence lamp 31, and are connected to each other by an internal lead 38.

The lamp unit 30 turns on each lamp according to the size of recording paper. For example, in case where the size of recording paper is A4, only the lamp 31 is turned on, and in case where the size of recording paper is A3, both of the lamps 31 and 32 are turned on.

SUMMARY

As disclosed in Japanese Patent Application Publication No. 2001-126846, the thickness of the tube of the incandescence lamp is made thin, in order to improve the light transmittance thereof. For example, when it is 0.85 mm or less, the strength of the tube decreases, so that it is easily damaged, making handling thereof complicated.

In view of the problem of the prior art, it is an object of the present invention to offer an incandescence lamp having a filament in a tube thereof and an incandescence lamp unit equipped with two or more incandescence lamps, wherein it is possible to reinforce the strength of the tube, thereby making the thickness of the tube thin, and to realize improvement of the light transmittance thereof. In order to solve the above problem, an incandescence lamp according to the present invention, comprises a reinforcement rib extending along a tube axis direction on a tube, which has a filament inside thereof. Furthermore, two or more incandescence lamps may be provided, each of which is equipped with a filament extending in the tube axis direction within the tube, and the filament, which is a light emission part, and an internal lead, which is a non-light emission part, may be provided in each of the lamps. In such an incandescence lamp unit, in which the filaments of the respective lamps are arranged so as to shift from each other in the tube axis direction, a reinforcement rib which extends along the tube axis direction is provided on a portion of the tube of the incandescence lamp, corresponding to the internal lead, which is the non-light emission part.

According to the present invention, since the reinforcement rib, which extends along the tube axis direction, is provided on the tube thereof, the strength of the tube can be reinforced, so that the tube can be made thin, which improves the light transmittance. Moreover, in the incandescence lamp unit having two or more incandescence lamps, wherein the positions of the filaments, which are light emission parts of the respective lamps, shift from each other, the reinforcement rib extending along the tube axis direction is provided at a position of the tube of each lamp, which corresponds to the internal lead, so that it is possible to transmit light from the light emission part to the outside thereof, without interference, while reinforcing the strength of the tube.

BRIEF DESCRIPTION OF THE DRAWINGS

Other features and advantages of the present incandescence lamp will be apparent from the ensuing description, taken in conjunction with the accompanying drawings, in which.

DESCRIPTION

Figure 1A:
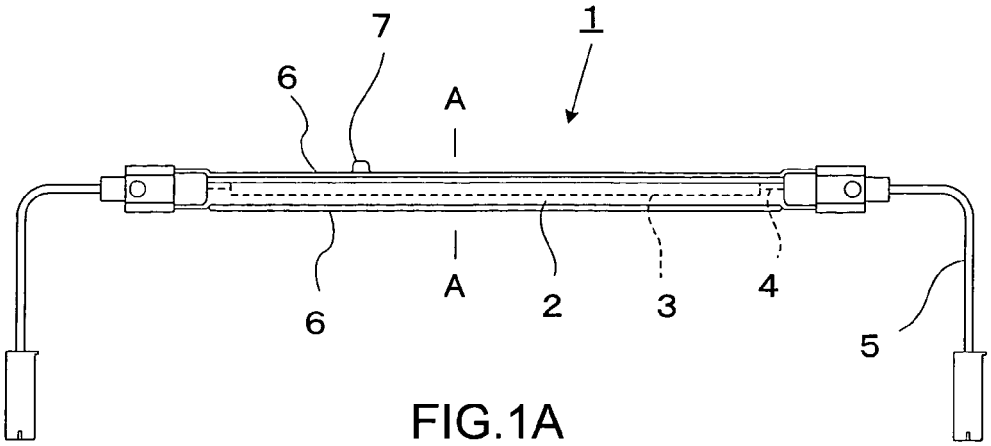
FIG. 1 is an overall view of an incandescence lamp according to the present invention.
Figure 1B:
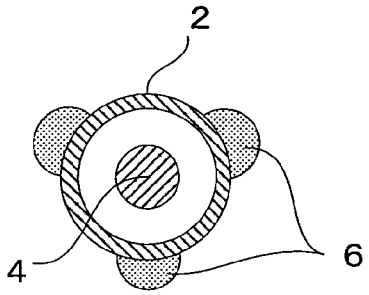

FIGS. 1A and 1B show an incandescence lamp according to the present invention, wherein FIG. 1A is an overall view thereof, and FIG. 1B is an enlarged cross sectional view thereof, taken along a line IB-IB of FIG. 1A. In the figure, the incandescence lamp 1 has a straight tube shaped tube 2, which has sealing portions at both ends thereof, and a filament 3, which is disposed therein along a tube axis direction. The filament 3 is connected to an external lead 5 through an internal lead 4. And inactive gas and halogen gas are enclosed in the tube 2.

Linear reinforcement ribs 6 and 6, which extend along the tube axis direction, are provided on an outer circumferential surface of the tube 2.

The number of the reinforcement ribs 6 is chosen depending on the diameter of the tube 2, and/or the size of reinforcement ribs 6. In addition, in this case, it is desirable to form the reinforcement ribs 6, so as to avoid the position of an exhaust chip 7 of the tube 2.

Although in the above-mentioned embodiment, such a structure in which the reinforcement ribs 6 and 6 are formed on the outer circumferential surface of the tube 2, is shown, the structure is not limited thereto. The reinforcement ribs 6 and 6 can be formed on an inner circumference face thereof.

Figure 2:
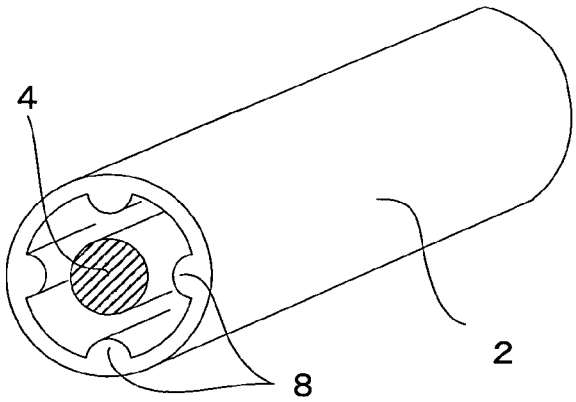
FIG. 2 is a perspective view of a first embodiment thereof.

FIG. 2 shows such a structure, in which linear reinforcement ribs 8 and 8 are formed on the inner circumference face of the tube 2 so as to extend in a tube axis direction.

Figure 3:
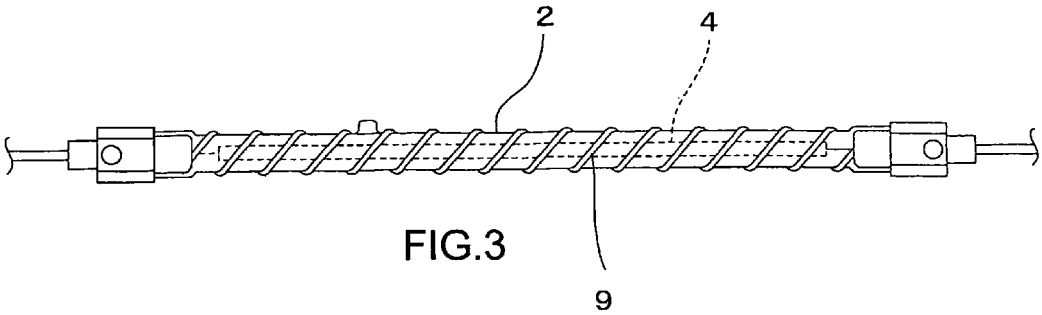
FIG. 3 is an overall view of a second embodiment thereof.

Moreover, FIG. 3 shows another embodiment, wherein a reinforcement rib 9 is spirally formed on an outer circumferential surface of a tube 2, and extends along the tube axis direction.

Figure 4:
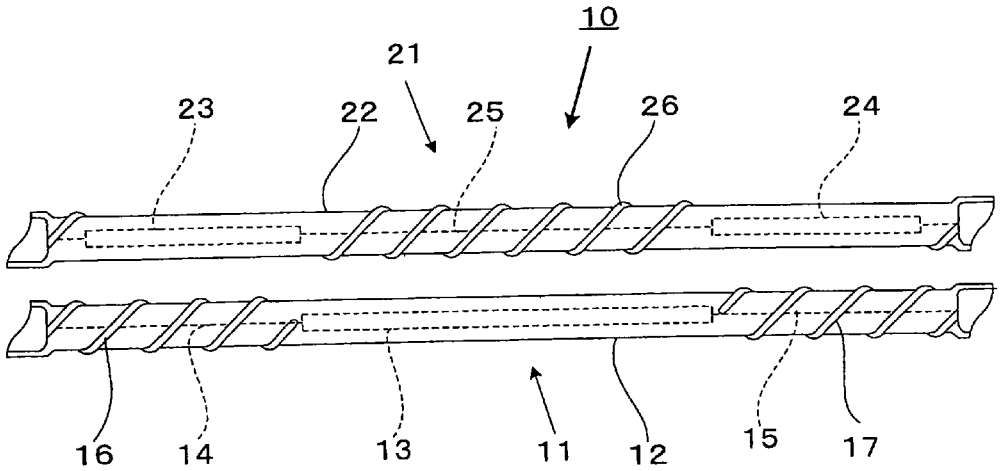
FIG. 4 is an overall view of a third embodiment thereof.
Figure 5:
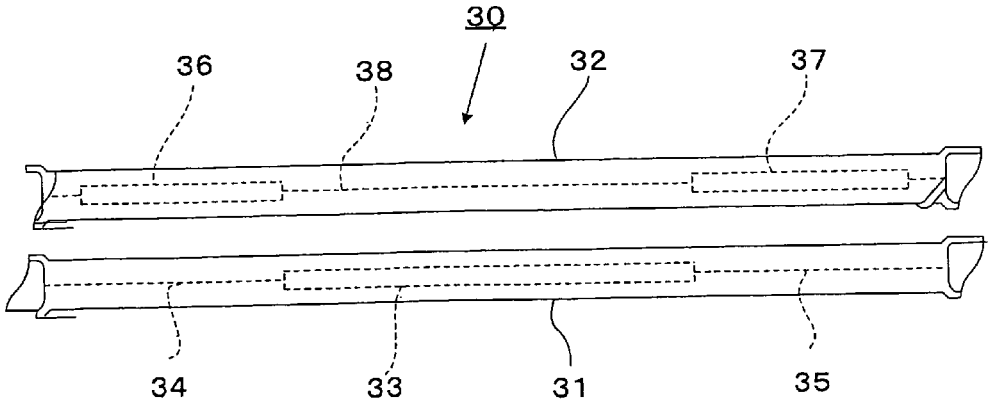
FIG.5 PRIOR ART
FIG. 5 shows an example of prior art.

FIG. 4 shows an incandescence lamp unit 10 having such two or more incandescence lamps, wherein the incandescence lamp unit 10 is made up of two incandescence lamps 11 and 21. A filament 13, which is a light emission part, is arranged at a central part of a tube 12 of one incandescence lamp 11, and internal leads 14 and 15, which are non-light emission parts, are connected to both ends of the filament 13. And spiral reinforcement ribs 16 and 17 are formed on portions of the outer circumferential surface of the tube 12, which respectively correspond to the internal leads 14 and 15, and no reinforcement rib is formed on a portion of the outer circumferential surface, which corresponds to the filament 13.

On the other hand, filaments 23 and 24 are arranged in both end sides of a tube 22 of the other discharge lamp 21, and are connected to each other by an internal lead 25 located in the central part thereof. These filaments 23 and 24 are disposed at the positions which respectively correspond to the internal leads 14 and 15 of the one lamp 11, and the internal lead 25 is disposed at the position, which corresponds to the filament 13 of the one of lamps 11. And the spiral reinforcement rib 26 is formed at the position, which corresponds to the internal lead 25, which is located at the central part, on the outer circumferential surface of the tube 22, and no reinforcement rib is formed at the positions, which correspond to the filaments 23 and 24 in the both end sides thereof.

In addition, although FIG. 4 shows the spiral reinforcement ribs 16, 17, and 26, which may be linear as in FIG. 1. Moreover, although, in this embodiment, an example of the two incandescence lamps are shown, the number of the lamps is not limited thereto, and for example, the number of the lamps may be 3 or more. In the case where it is three or more, the positions of the filaments, which are light emission parts, are shifted from one another in the respective lamps in the tube axis direction, and the reinforcement ribs are formed in portions corresponding to the internal leads, which are non-light emission parts, in each lamp.

As mentioned above, the strength of the tube can be reinforced in the incandescence lamp according to the present invention by forming the reinforcement ribs extending along the tube axis direction in the tube having a filament, and it is possible to make the tube thin, thereby improving the light transmittance thereof. Moreover, in the incandescence lamp unit having two or more incandescence lamps, in which the positions of the filaments, which are light emission parts of the respective incandescence lamps, are shifted from one another, the reinforcement rib extending along the direction of the tube axis is provided on a position of the tube of each lamp, which corresponds to the internal lead. Therefore, while the strength of the tube is reinforced, since no reinforcement rib is formed in the position corresponding to each filament, light from the filament is emitted to the outside thereof without interference of the reinforcement rib.

The preceding description has been presented only to illustrate and describe exemplary embodiments of the present incandescence lamp. It is not intended to be exhaustive or to limit the invention to any precise form disclosed. It will be understood by those skilled in the art that various changes may be made and equivalents may be substituted for elements thereof without departing from the scope of the invention. In addition, many modifications may be made to adapt a particular situation or material to the teachings of the invention without departing from the essential scope. Therefore, it is intended that the invention not be limited to the particular embodiment disclosed as the best mode contemplated for carrying out this invention, but that the invention will include all embodiments falling within the scope of the claims. The invention may be practiced otherwise than is specifically explained and illustrated without departing from its spirit or scope.

What is claimed is:

1. An incandescence lamp comprising:

a tube that has sealing portions forming both ends;

a filament that extends in the tube in a tube axis direction;

an internal lead that is connected to the filament; and a reinforcement rib on the tube that extends along the tube axis direction;

wherein a thickness of the tube is 0.85 mm or less; and wherein the reinforcement rib is formed on the tube at a location radially adjacent to the internal lead and is not formed on the tube at another location radially adjacent the filament.

2. The incandescence lamp according to claim 1, wherein the reinforcement rib is linear and on an outer circumferential surface of the are tube.

3. The incandescence lamp according to claim 1, wherein the reinforcement rib is spirally formed on an outer circumferential surface of the are tube.

4. An incandescence lamp unit comprising two or more incandescence lamps, each incandescence lamp comprises a tube and a reinforcement rib;

wherein the tube comprises sealing portions forming both ends, at least one filament extending in a tube axis direction and an internal lead connected to the filament;

wherein a thickness of the tube is 0.85 mm or less;

wherein the at least one filament of a first incandescence lamp is shifted in the tube axis direction relative to the at least one filament of a second incandescence lamp; and further wherein the reinforcement rib extends along the tube axis direction and is formed corresponding to a location of the internal lead; and wherein the reinforcement rib is formed on the tube at a location radially adjacent to the internal lead and is not formed on the tube at another location radially adjacent to the filament.

5. The incandescence lamp unit according to claim 4, wherein the first incandescence lamp has one filament arranged at a central part of the tube in the tube axis direction, the second incandescence lamp has two filaments located at both sides of the tube.

* * * * *